US008896644B2

(12) United States Patent
Sunouchi et al.

(10) Patent No.: US 8,896,644 B2
(45) Date of Patent: Nov. 25, 2014

(54) RECORDING APPARATUS

(75) Inventors: Shunya Sunouchi, Kawasaki (JP); Haruo Uchida, Yokohama (JP); Hiroyuki Saito, Yokohama (JP); Noriyuki Sugiyama, Kawasaki (JP); Kentaro Onuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/541,308

(22) Filed: Jul. 3, 2012

(65) Prior Publication Data

US 2012/0268542 A1 Oct. 25, 2012

Related U.S. Application Data

(63) Continuation of application No. 11/676,436, filed on Feb. 19, 2007, now Pat. No. 8,235,521.

(30) Foreign Application Priority Data

Feb. 20, 2006 (JP) ..... 2006-042228

(51) Int. Cl.

| | |
|---|---|
| ***B41J 2/01*** | (2006.01) |
| ***B65H 5/02*** | (2006.01) |
| ***B65H 5/04*** | (2006.01) |
| ***B41J 13/076*** | (2006.01) |
| ***B65H 29/14*** | (2006.01) |

(52) U.S. Cl.

CPC ..... *B41J 13/076* (2013.01); *B65H 2404/143* (2013.01); *B65H 2402/52* (2013.01); *B65H 29/14* (2013.01)

USPC ..... 347/140; 271/274

(58) Field of Classification Search

CPC ..... B41J 2/01; B65H 5/00; B65H 7/00

USPC ..... 347/1, 101, 104; 271/8.1, 264, 272, 271/273, 274

See application file for complete search history.

(56) References Cited

U.S. PATENT DOCUMENTS

| | | | | |
|---|---|---|---|---|
| 6,170,817 | B1 * | 1/2001 | Kawaguchi | 271/167 |
| 2002/0135122 | A1 * | 9/2002 | Hiramatsu | 271/264 |
| 2007/0176955 | A1 * | 8/2007 | Yoshida | 347/16 |

* cited by examiner

*Primary Examiner* — Justin Seo
*Assistant Examiner* — Kendrick Liu
(74) *Attorney, Agent, or Firm* — Canon USA, Inc., IP Division

(57) ABSTRACT

A recording apparatus has a pair of bearings 38 having: two surfaces 38*a* and 38*b* which support both edge portions of a conveying roller 40; driven rollers 42 which press the conveying roller 40 in the direction where extension lines of the two surfaces 38*a* and 38*b* cross; and further, an intermediate bearing 47 which presses the conveying roller 40 in the direction of a point where the extension lines of the two surfaces 38*a* and 38*b* cross.

10 Claims, 8 Drawing Sheets

RECORDING APPARATUS

CROSS-REFERENCE TO RELATED APPLICATIONS

This application is a continuation of U.S. patent application Ser. No. 11/676,436 filed Feb. 19, 2007, which claims the priority of Japanese Patent Application No. 2006-042228, filed Feb. 20, 2006, all of which are hereby incorporated by reference herein in their entirety.

BACKGROUND OF THE INVENTION

1. Field of the Invention

The present invention relates to a recording apparatus for recording an image onto a recording sheet which is conveyed through a recording unit and, more particularly, to a conveying roller for conveying the recording sheet and a bearing of the conveying roller.

2. Description of the Related Art

Generally, a recording apparatus having a function of a printer, a copying apparatus, a facsimile, or the like is constructed so as to form an image (including characters, symbols, or the like) onto a recording sheet such as paper, cloth, plastics sheet, OHP sheet, or the like by using recording head on the basis of image information. As a scanning system in the recording apparatus, there are serial and line types. The serial type is a system in which the image is recorded while alternately repeating a main scan for moving the recording head along the recording sheet and a sub-scan for conveying the recording sheet at a predetermined pitch. The line type is a system in which the image is recorded only by the conveyance (sub-scan) of the recording sheet while recording the image of one line in a lump. The recording apparatuses can be classified into an ink jet type, a thermal transfer type, a laser beam type, a thermal sensitive type, a wire dot type, and the like in accordance with the kind of recording head.

In recent years, in recording apparatuses, particularly in ink jet recording apparatuses, image quality of the output image has been improved and the precision necessary regarding the recording operation to realize high image quality is continuing to improve. For example, in ink jet recording apparatus, one means for improving the image quality of the recording image is a means for reducing the ink discharge amount per dot and decreasing the diameter of each dot on the recording sheet, to reduce granularity of the dots of the ink discharged onto the image. When the size of dot decreases, an area where the dots have to overlap enters the state where they do not overlap. In other words, if an arrival position of the dot changes slightly, the non-overlap state appears (or an area where the dots do not have to overlap enters the state where they overlap) and a concentration or hue of this area is deviated. Such a deviation in the concentration or hue becomes a white stripe, a black stripe, or an uneven color, causing a deterioration in image quality. The positional deviation between the dots mentioned here is on the level of tens of μm to a few μm. A means for assuring such a precision is necessary.

One important mechanism regarding the improvement of image quality is the mechanism for conveying the recording sheet by a plurality of conveying rollers. In such a mechanism, in order to improve the image quality, first, it is necessary to improve the eccentricity, cylindricity, and diameter tolerance of the conveying rollers, and the grade of gear. It is also effective to use a construction in which a conveyance amount coincides with an amount of rotation of the number of integer times of the motor or the gear. This makes a stop error of the motor and an eccentricity precision component of the gear cancel one another.

However, in conventional recording apparatus, although consideration has been given to the precision of a theoretical rotation amount (conveying plane movement amount) with respect to the conveying rollers for conveying the recording sheet, a countermeasure against restriction of the positions of the conveying rollers is insufficient. In the conveying roller which is arranged on the downstream side of the recording head (for example, what is called a discharge roller), particularly, a consideration and a countermeasure against such a point are insufficient. FIG. 8 is a cross sectional view showing a general conveying roller and its bearing in the conventional recording apparatus, taking an example of a discharge roller. In FIG. 8, there are a discharge roller 1001; a bearing 1002 of the discharge roller; and a driven roller 1003. The driven roller 1003 is pressed to the discharge roller 1001 by a force Fs by a spring (not shown) in order to produce a conveying force of the recording sheet.

A looseness of the discharge roller 1001 in the bearing 1002 causes it the roller to deviate in the downward direction in the diagram because of the pressing force Fs of the driven roller 1003. The cross sectional shape of both the discharge roller 1001 and the bearing 1002 is circular. Therefore, the apparatus has a construction in which play exists, and the discharge roller 1001 is easily moved in the directions shown by arrows Y and Y' on an inner circumference of the bearing 1002. Consequently, if an external force due to a disturbance is applied, the discharge roller 1001 is liable to be moved and the position is difficult to be fixed. Since the position of the discharge roller is difficult to be fixed as mentioned above, it is difficult to maintain the high conveyance precision of the recording sheet and it is difficult to improve the image quality of the recording image.

SUMMARY OF THE INVENTION

It is an object of the invention to stabilize the position of a conveying roller in use. Another object of the invention is to provide a recording apparatus in which when a recording sheet is conveyed only by a conveying roller or when a rear edge of the recording sheet comes out from another conveying roller arranged on an upstream side of a recording head, movement of the conveying roller is suppressed, and the recording sheet can be conveyed with high precision.

Further features of the present invention will become apparent from the following description of exemplary embodiments with reference to the attached drawings.

DESCRIPTION OF THE EMBODIMENTS

Figure 1:
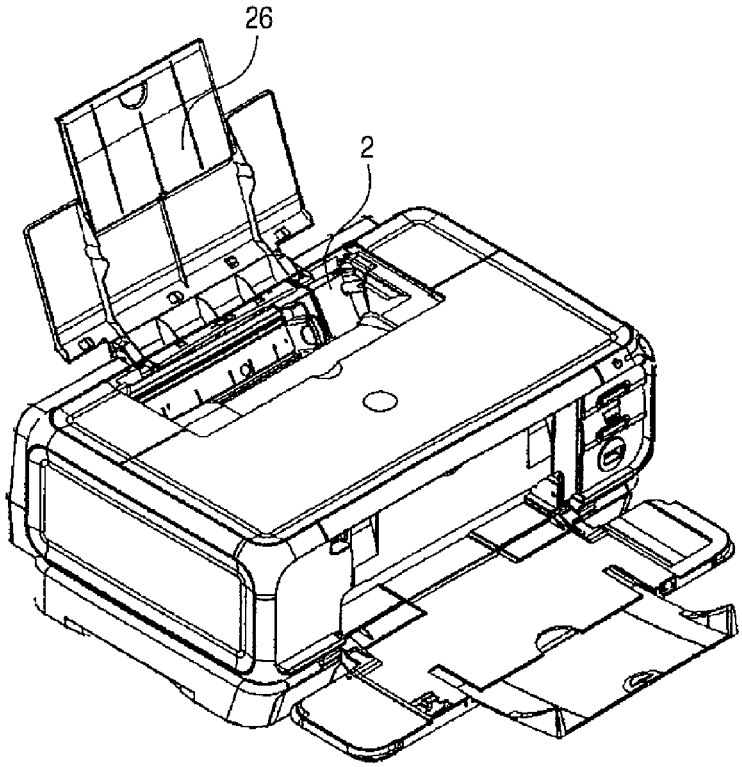
FIG. 1 is a perspective view of an embodiment of a recording apparatus to which the invention is applied.
Figure 2:
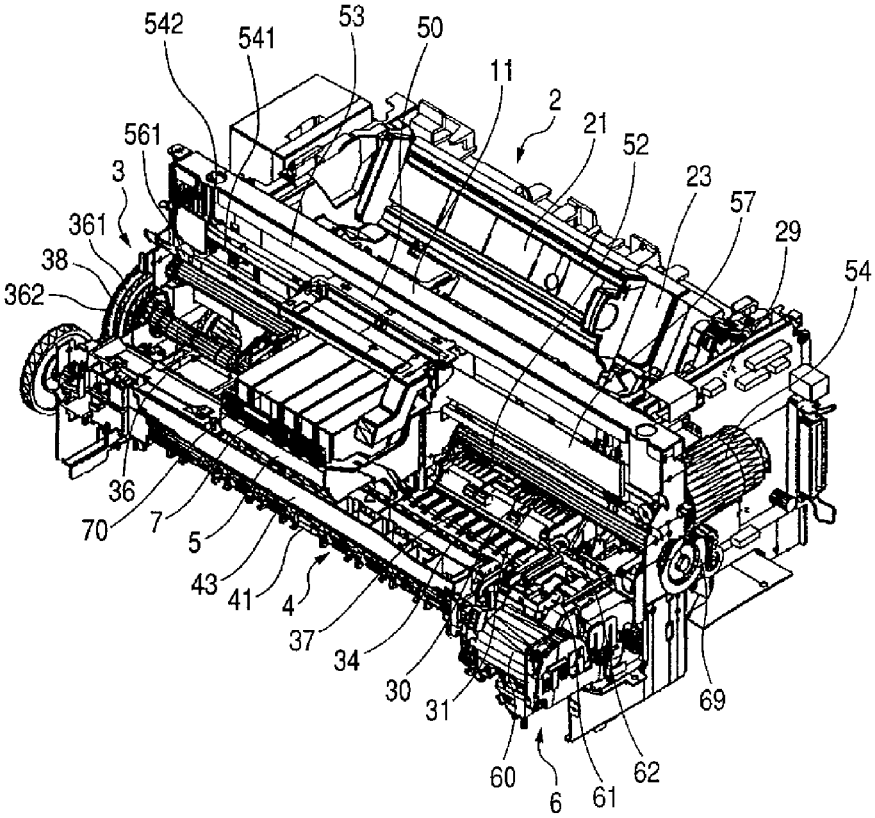
FIG. 2 is a perspective view of an internal construction of the embodiment of the recording apparatus to which the invention is applied.
Figure 3:
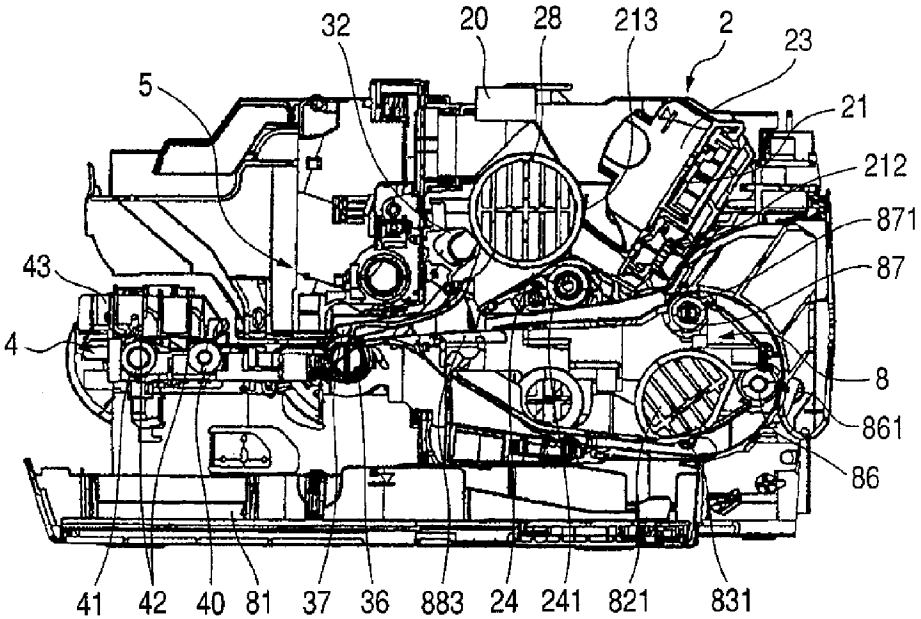
FIG. 3 is a vertical sectional view of the recording apparatus of FIG. 2.

An embodiment of the invention will be specifically explained hereinbelow with reference to the drawings. In all of the drawings, the same or corresponding portions are designated by the same reference numerals. FIG. 1 is a perspective view of the embodiment of a recording apparatus to which the invention is applied. FIG. 2 is a perspective view of an internal construction of the embodiment of the recording apparatus to which the invention is applied. FIG. 3 is a vertical sectional view of the recording apparatus of FIG. 2. FIGS. 1, 2 and 3 show an example of a case where the recording apparatus is an ink jet recording apparatus. In FIGS. 1, 2 and 3, the recording apparatus has a sheet-feeding unit 2, a sheet sending unit 3, a sheet discharging unit 4, a recording unit 5, a recovery processing unit 6, and a U-turn conveying unit 8. The recording unit 5 is constructed in such a manner that while a recording medium is scanned, an image is recorded by a reciprocatively moveable recording head 7 mounted on a carriage 50. A sheet feeding tray and a sheet discharging tray which can be opened and closed as will be explained hereinafter are provided for an exterior-mounting portion of the apparatus.

First, the sheet feeding unit 2 will be explained. The sheet feeding unit 2 is constructed by attaching a pressing plate 21 on which a recording sheet is stacked, a feed roller 28 for feeding the recording sheet, a separating roller 241 for separating the recording sheet, and the like onto a base 20. A sheet feeding tray 26 to hold a rear edge side of each of the recording sheets stacked on the pressing plate 21 is attached to the exterior-mounting portion in the rear portion of the apparatus. The feed roller 28 is an arc-shaped roller in a shape obtained by cutting away a part of a circle. The separating roller 241 is provided at a position closer to a reference surface to restrict a side edge position of the recording sheet. The feed roller 28 is driven by a motor 69 which is used in common with the recovery processing unit 6. Speed control of the feed roller 28 is made by PWM value control for controlling an electric power on the basis of a detection value of a rotational speed.

A movable side guide 23 to restrict the stacking position of the recording sheets is slidably attached to the pressing plate 21. The pressing plate 21 can swing around an axial core, as a rotational center, provided for the base 20 and is urged to the feed roller 28 by a pressing plate spring 212. A separating sheet 213 to prevent an overlap feeding of the recording sheets is provided at a position of the pressing plate 21 which faces the feed roller. The separating sheet is made of a material of a large coefficient of friction. The pressing plate 21 is come into contact with and is away from the feed roller 28 at predetermined timing by a pressing plate cam (not shown).

A separating roller holder 24 having the separating roller 241 to separate the recording sheets one by one is attached to the base 20. The separating roller holder can rotate around a rotary axis provided for the base 20 as a rotational center and is urged to the feed roller 28 by a separating roller spring (not shown). The separating roller 241 is axially supported through a clutch spring (torque limiter). When a load torque of a predetermined value or more acts, the separating roller 241 is rotated. The separating roller can be moved into contact with and away from the feed roller. The positions of the pressing plate 21, separating roller 241, and the like are detected by an ASF (Automatic Sheet Feeder) sensor 29.

The sheet sending unit 3 will now be described. An upstream conveying roller 36 for conveying the recording sheet and a PE (paper edge) sensor 32 are provided for the sheet sending unit 3. The upstream conveying roller 36 is a roller in which the surface of a metal axis has been coated with micro particles of ceramics. The upstream conveying roller 36 is axially supported in metal axis portions at both ends by bearings 38 provided for a chassis 11. A plurality of pinch rollers 37 have been come into contact with the upstream conveying roller 36 so as to be driven-rotated. Each pinch roller 37 is a rotor which is driven-rotated in association with the upstream conveying roller 36. The pinch rollers 37 are held by a pinch roller holder 30. When the pinch rollers 37 are urged to the upstream conveying roller 36 by a pinch roller spring 31, a conveying force is produced.

A pulley 361 is provided for an axis of the upstream conveying roller 36. The upstream conveying roller 36 is driven by transferring a rotational force of a conveying motor to the pulley 361 by a timing belt. A code wheel 362 to detect a conveyance amount is provided for an axis of the upstream conveying roller 36. A marking of this code wheel is read by an encoder sensor 363 attached to an adjacent portion, so that the conveyance amount is detected. The recording sheet can be accurately conveyed by the upstream conveying roller 36 through the recording unit 5, which will be explained hereinafter. The image is recorded onto the whole recording sheet by alternately repeating the image recording which is executed by the recording head 7 and the conveyance of the recording sheet.

Figure 4:
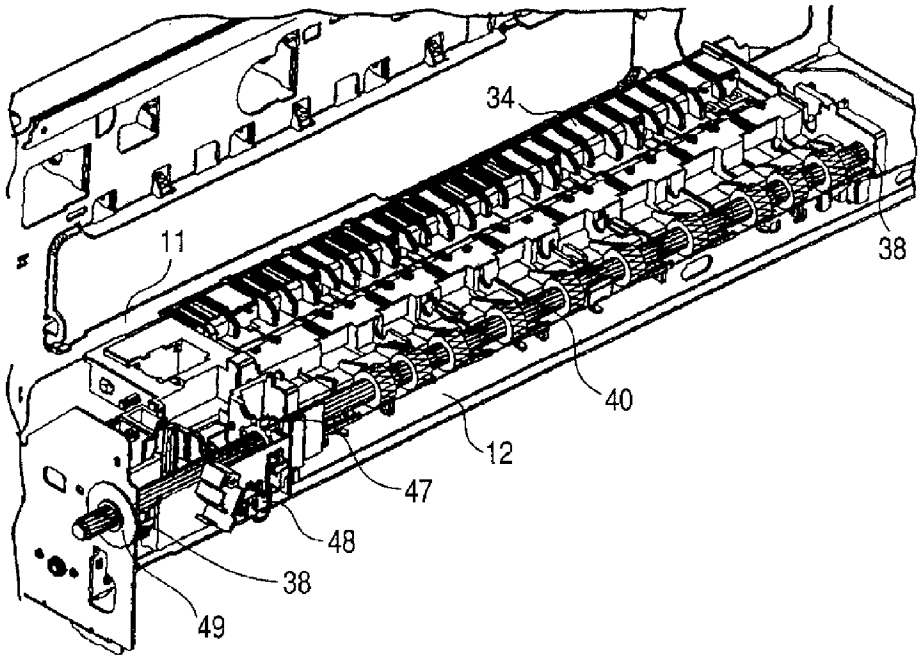
FIG. 4 is a perspective view showing a construction around downstream conveying rollers in the first embodiment of the invention.

The recording unit 5 will now be described. The recording head 7 to record the image onto the recording sheet on the basis of the image information is provided for the recording unit constructed on the downstream side in the conveying direction of the upstream conveying roller 36. The recording head 7 is mounted on the carriage 50 which can be moved back and forth in the width direction of the recording sheet. The recording head of the embodiment is an ink jet recording head. FIG. 4 is a perspective view of the recording head 7 mounted on the carriage 50 in FIG. 2. In FIG. 4, the recording head 7 has an ink discharging unit having a plurality of discharge ports for discharging ink droplets on the basis of the image information. A discharge surface formed with a plurality of discharge port trains comprising an array of discharge ports is formed in the ink discharging unit. An ink tank 70 of each color is exchangeably attached to the ink discharging unit. The ink discharging unit can be for example one having an electro-thermal converting system in which heat energy is applied to the ink in the ink discharge port by a heater and the ink is film-boiled by the heat. That is, the ink droplet is discharged from the discharge port of the recording head 7 by a pressure change that is caused by a growth or contraction of a bubble formed by the film boiling. By selectively discharging the ink droplet from each discharge port on the basis of the image information, the image can be recorded onto the recording sheet.

The carriage 50 is guided and supported along a guide shaft 52 and a guide rail 53 so that it can be reciprocatively moved in the width direction of the recording sheet. The guide shaft 52 is attached to the chassis 11. The guide rail 53 is formed integratedly with the chassis. The carriage 50 is driven by a carriage motor 54 through a timing belt 541 suspended between a motor pulley and an idle pulley 542. A codes strip 561 is provided in parallel with the guide shaft 52. Markings have been formed on the codes strip 561 at a pitch of, for example, 150 to 300 lpi. By reading the markings by an encoder sensor mounted onto the carriage 50, the position and speed of the carriage 50 can be detected. A flexible board 57 to transmit a head signal to the recording head 7 is provided for the carriage 50. In the recording unit 5, the recording sheet is conveyed through the image forming position by the upstream conveying roller 36 and the pinch rollers 37. By moving the carriage 50 to the recording sheet, the image of one line is recorded by the recording head 7 on the basis of the image information. The image is recorded onto the whole recording sheet by alternately repeating the conveying operation and the recording of the image of one line.

The sheet discharging unit 4 will now be explained. The sheet discharging unit 4 has two downstream conveying rollers 40 and 41. Those downstream conveying rollers are coupled with the upstream conveying roller 36 through a gear train or the like and driven synchronously with the upstream conveying roller 36. A driven roller 42 is urged to each downstream conveying roller so that the roller can be driven-rotated. In the embodiments, the downstream conveying rollers 40 and 41 are attached to a platen 34. The driving force of the upstream conveying roller 36 is transferred to the first downstream conveying roller 40 and the driving force of the first downstream conveying roller 40 is transferred to the second downstream conveying roller 41 through an idle gear. Each of the driven rollers 42 which are driven-rotated in association with the downstream conveying rollers 40 and 41 has a structure in which a thin plate made of SUS or the like and having a plurality of convex shapes around the circumference is molded integratedly with a resin portion. Each driven roller 42 is rotatably supported to a driven roller holder 43 by a shaft formed by a coil spring. The driven rollers 42 are pressed to the downstream conveying rollers 40 and 41 by the coil springs. The recorded sheet is sandwiched by nip portions between the downstream conveying rollers 40 and 41 and the driven rollers 42, conveyed, and ejected to the outside from the apparatus main body.

The recovery processing unit 6 will now be described. The ink jet recording apparatus is provided with the recovery processing unit 6 for preventing a clog of the discharge port of the recording head and maintaining and recovering ink discharge performance. The recovery processing unit 6 has a suction pump 60, a cap 61, and a wiper 62. The cap 61 is adhered to the discharge surface of the recording head 7 and covers the discharge port, thereby reducing drying of the ink in the recording head. The suction pump 60 operates in the state where the discharge port is hermetically sealed by the cap 61, thereby sucking the ink from the discharge port and refreshing the ink in the discharge port. The wiper 62 sweeps and cleans the discharge surface of the recording head. As a suction pump 60, besides a pump of a piston cylinder type, what is called a tube pump or the like which allows a negative pressure generated in a tube to act on the discharge port or the like is used.

The U-turn conveying unit 8 will now be described. A U-turn conveying path for enabling duplex printing is provided for the U-turn conveying unit 8. A sheet-feeding cassette 81 in which the recording sheets have been enclosed is attached to a position near the front side of a lower portion of the apparatus main body. A pressing plate for allowing the stacked recording sheets to be put into contact with a feed roller 821 is provided in the sheet feeding cassette 81. The top one of the recording sheets is separated and conveyed to the U-turn conveying path by the cooperation of the feed roller 821, a separating roller 831, and the separated sheet. The recording sheet is conveyed toward the recording unit 5 by first and second intermediate rollers 86 and 87 provided at two positions on the U-turn conveying path and by pinch rollers 861 and 871 urged to the intermediate rollers 86 and 87.

A change-over flapper 883 is arranged at a meeting point of the conveying path of the sheet feeding unit 2 and the conveying path of the U-turn conveying unit 8. The recording sheet conveyed from the U-turn conveying unit 8 is turned upside down and, thereafter, fed to a portion between the upstream conveying roller 36 and the pinch roller 37 through the change-over flapper 883. The subsequent operation is substantially the same as that of the recording sheet which is fed from the sheet feeding unit 2. That is, the recording sheet is conveyed by the sheet sending unit 3, the image is recorded onto the recording sheet by the recording unit 5, and the sheet is ejected to the outside from the sheet discharging unit 4.

Figure 5:
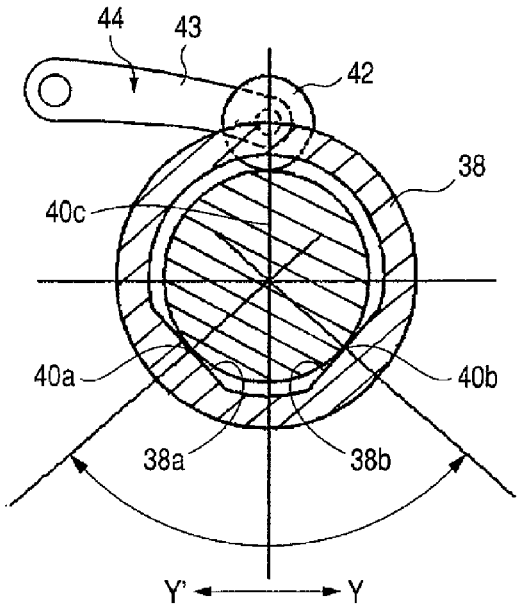
FIG. 5 is a cross sectional view showing the downstream conveying roller in FIG. 4 and a bearing thereof.
Figure 6:
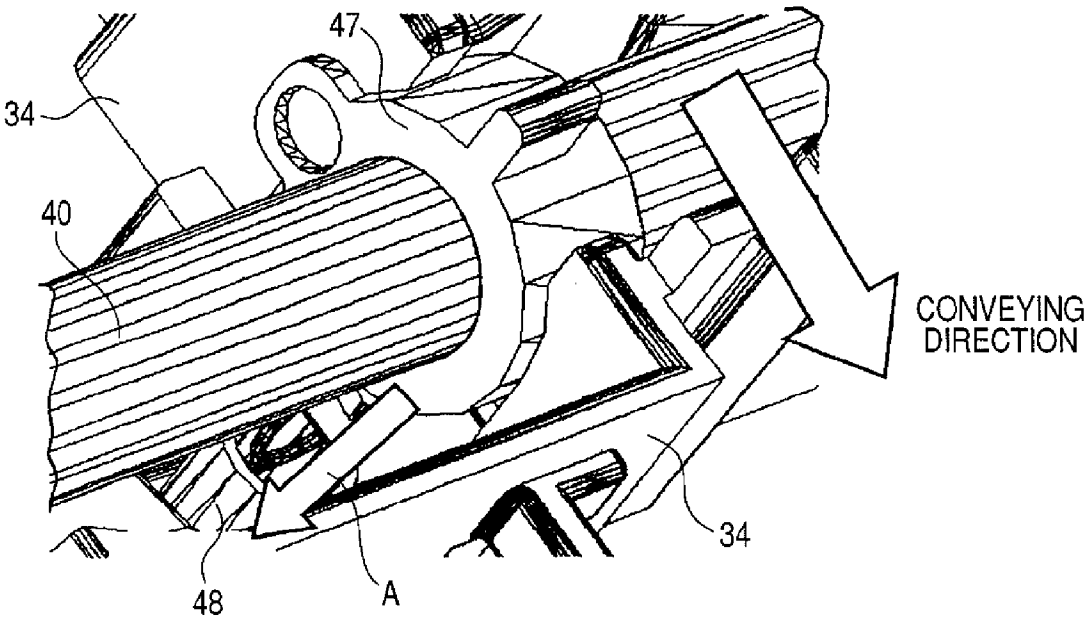
FIG. 6 is a partial perspective view showing details of a bearing portion of the downstream conveying roller in FIG. 4 and showing a pressing direction and a position restricting direction.

FIG. 4 is a perspective view showing a construction around the downstream conveying rollers in the first embodiment of the recording apparatus to which the invention is applied. FIG. 5 is a cross sectional view showing the downstream conveying roller in FIG. 4 and a bearing thereof. FIG. 6 is a partial perspective view showing details of the bearing portion of the downstream conveying roller in FIG. 4 and showing the pressing direction and the position restricting direction. The construction and operation for stabilizing the position of the conveying roller in the embodiment will now be described with reference to FIGS. 4, 5 and 6. The case where the conveying roller to stabilize the position is the downstream conveying roller 40 will now be explained as an example. That is, by stabilizing the position of the downstream conveying roller 40, the occurrence of an error of the conveyance amount of the recording sheet that is caused by the movement of the downstream conveying roller 40 is prevented. The movement of the downstream conveying roller 40 is liable to occur, for example, when the rear edge of the recording sheet is taken away from the upstream conveying roller 36 or when the recording sheet is conveyed only by the downstream conveying rollers 40 and 41.

As shown in FIG. 4, both edges of the downstream conveying roller 40 are supported by the bearings 38. An intermediate bearing 47 having a bore surface which comes into contact with the peripheral surface of the downstream conveying roller 40 is provided between (inside) the two bearings 38. One end portion of the downstream conveying roller 40 is supported by the chassis 11 and a bushing 49 and the other end portion is supported by a bearing of the platen 34 fitted and attached to the chassis 11. It is also possible to use a construction in which both of the edges of the downstream conveying roller 40 are supported by the chassis 11 or the platen 34. In the embodiment, a bore portion of the intermediate bearing 47 which axially supports the discharge roller 40 has a circular shape and an outer diameter of the downstream conveying roller 40 and the bore (inner diameter) of the intermediate bearing 47 are set so that the downstream conveying roller 40 and the intermediate bearing 47 are fitted in the state where play of between 10 and 90 μm is permitted.

The position of the intermediate bearing 47 can be selected to any desired position so long as it lies within a region that is between the two bearings 38 and outside of the maximum width of the recording sheet which can be conveyed. A portion which has been press-molded into a U-character cross sectional shape is provided on the front surface of the chassis 11. In order to assure the strength of the chassis 11, a front chassis 12 as another part made of sheet metal is provided for the front surface in parallel with the downstream conveying roller 40. The intermediate bearing 47 is downwardly urged by an intermediate bearing spring 48 as shown by arrow A in FIG. 6. In one end portion of the intermediate bearing spring 48, the spring 48 is hooked and retained to a hook-shaped portion of the intermediate bearing 47. In the other end portion, the spring 48 is hooked and retained to a hook-shaped portion of the front chassis 12. Thus, the downstream conveying roller 40 is put into pressure contact with an upper portion of the circular bearing surface of the intermediate bearing 47 and the necessary looseness occurs in the lower portion.

FIG. 5 shows a structure of the bearings 38 in both end portions of the downstream conveying roller 40. As shown in FIG. 3, the driven rollers 42 are pressed to the downstream conveying rollers 40 and 41 by springs 44, respectively. The driven rollers 42 are attached to the driven roller holder 43 through the springs 44. In FIG. 5, a pressing force of the driven rollers 42 and a pressing force of the intermediate bearing 47 by the intermediate bearing spring 48 act on the downstream conveying roller 40.

The two driven rollers 42 are attached to a driven roller attaching portion at one position of the holder 43. A force of the springs 44 which press the two driven rollers 42 is set to, for example, 30 to 60 gf. Thus, a total of the pressing forces of a plurality of driven rollers 42 which are pressed by the downstream conveying roller 40 is equal to, for example, 300 to 600 gf. On the other hand, a pressing force which acts on the downstream conveying roller 40 from the intermediate bearing 47 by the intermediate bearing spring 48 is set to, for example, 200 to 400 gf.

In order to assure the conveying force that is obtained by the downstream conveying roller 40, it is preferable to increase the force of the spring 44. However, if the force of the spring 44 is set to be too large, the projection front edge of the driven roller 42 can cause scratching. Therefore, it is suitable that the pressing force of the driven rollers 42 to the downstream conveying roller 40 is set to 300 to 600 gf in total in order to convey the recording sheet without scratching. However, if only the pressing force by the driven rollers 42 is used, it is insufficient to restrict the position of the downstream conveying roller 40. In the embodiment, therefore, in order to supplement the pressing force which is obtained by the driven rollers 42, a construction in which the pressing force of the intermediate bearing 47 mentioned above is made to act on the discharge roller 40 is used.

Each of the pair of bearings 38 for rotatably supporting the end portions of the downstream conveying roller 40 has two surfaces 38*a* and 38*b* for supporting the downstream conveying roller 40 in contact with two points or areas (40*a*, 40*b*) on the circumference of the downstream conveying roller 40. The direction of a bisector 40*c* of a line segment connecting the two contact points 40*a* and 40*b* coincides with the direction in which the driven rollers 42 are pressed to the downstream conveying roller 40 by the springs 44.

That is, the two planes 38*a* and 38*b* for supporting the downstream conveying roller 40 are formed on the bore surface of the bearing 38. In the embodiment, the planes 38*a* and 38*b* are formed symmetrically with respect to a vertical line passing through the center of the bearing 38. Perpendicular lines at the center positions of the two planes 38*a* and 38*b* pass through the center of the bearing 38, as shown in FIG. 5.

The two planes 38*a* and 38*b* are arranged with an angle therebetween of 45 to 135°. The bisector 40*c* of the line segment connecting the two points with which the downstream conveying roller 40 are come into contact coincides with the pressing direction of the driven rollers 42.

With such a construction, so long as the downstream conveying roller 40 does not float up from the bearing 38, the position of the downstream conveying roller 40 does not deviate in the conveying direction (directions shown by arrows Y and Y' in FIG. 5). The intermediate bearing 47 presses the downstream conveying roller 40 by the intermediate bearing spring 48 in the direction of the point where extension lines of the two planes 38*a* and 38*b* of the bearings 38 cross.

The intermediate bearing 47 is fitted at its outer circumference to the platen 34 and its position is restricted in the conveying direction of the downstream conveying roller 40. In the embodiment, the intermediate bearing 47 is urged to the downstream conveying roller 40 by a helical extension spring. In place of the helical extension spring, other biasing means such as for example a helical torsion spring, a plate spring, or the like may be used.

According to the embodiment described above, the position of the downstream conveying roller 40 in the conveying direction can be stabilized. Thus, it is possible to prevent the movement of the downstream conveying roller 40 in the conveying direction at the time when the rear edge of the recording sheet is taken away from the upstream conveying roller 36 or when the recording sheet is conveyed only by the downstream conveying rollers 40 and 41. With such a construction, a good, stable image can be recorded by preventing the occurrence of the error of the conveyance amount of the recording sheet that is caused by the movement of the downstream conveying roller relative to the bearing. Particularly, in the case of the ink jet recording apparatus, by improving the arrival precision of the fine ink droplet, the deviation in the concentration or hue which is caused by the deviation in the dot position is prevented, so that the image quality of the recording image can be improved.

In the embodiment, although the structure of the downstream conveying roller 40 has been explained as an example, the invention can be also similarly embodied in the upstream conveying roller 36 and a similar functional effect is obtained.

Figure 7:
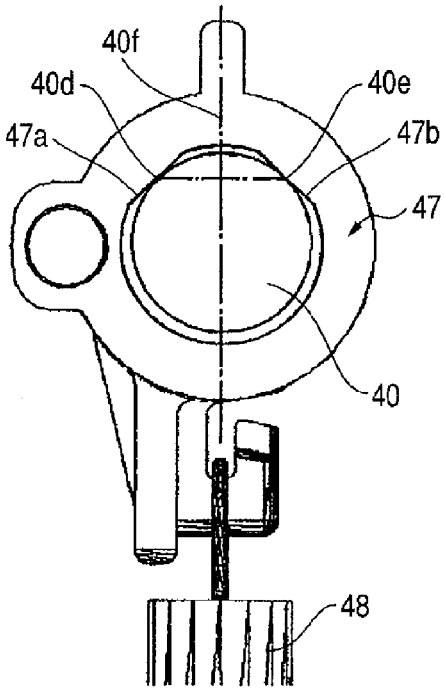
FIG. 7 is a cross sectional view showing a construction around downstream conveying rollers in the second embodiment of the invention.
Figure 8:
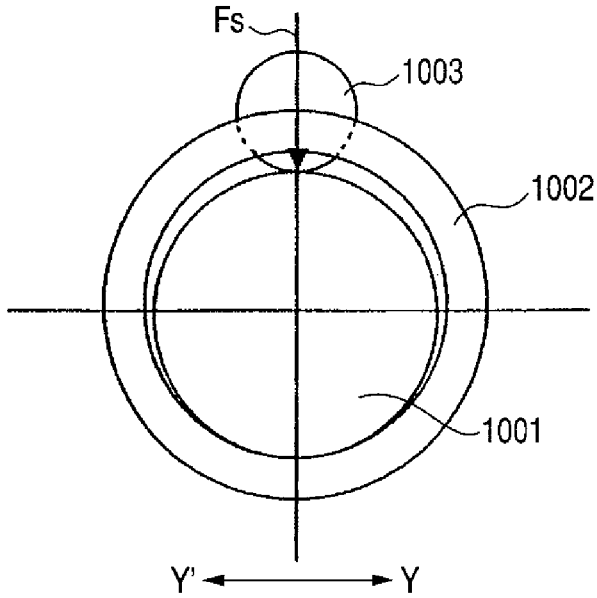
FIG. 8 is a cross sectional view showing a discharge roller and its bearing in a conventional recording apparatus.

FIG. 7 is a cross sectional view showing a construction around downstream conveying rollers in the second embodiment of the invention. In FIG. 7, the bore surface of the intermediate bearing 47 comes into contact with two points 40*d* and 40*e* on the circumference of the downstream conveying roller 40. The contact points 40*d* and 40*e* are selected to be the middle points of planes 47*a* and 47*b* of the intermediate bearing 47 which is come into contact with the circumferential surface of the downstream conveying roller 40. The direction of a bisector 40*f* of a line segment connecting the two contact points 40*d* and 40*e* coincides with the bisector of the line segment connecting the two points 40*a* and 40*b* of the downstream conveying roller 40 which come into contact with the bearings 38.

According to the second embodiment, a functional effect in which the movement in the conveying direction due to the recording sheet can be also prevented in the intermediate portion of the downstream conveying roller 40 is obtained. Thus, the movement of the downstream conveying roller can be prevented and the image quality of the recording image can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A conveying apparatus for conveying a sheet, the conveying apparatus comprising:

a conveying roller configured to convey the sheet;

a pair of bearings supporting the conveying roller, wherein each bearing has a first surface and a second surface which contact and support axis portions of the conveying roller;

a pressing roller which presses the conveying roller towards the first surface and the second surface, of each of the pair of bearings, wherein a first plane extended from the first surface and a second plane extended from the second surface are nonparallel and cross; and an intermediate bearing which is arranged between the pair of bearings and presses the conveying roller toward where the first plane and the second plane cross.

2. The conveying apparatus according to claim 1, wherein the conveying roller and the pressing roller nip the sheet.

3. The conveying apparatus according to claim 2, wherein the conveying roller and the intermediate bearing do not nip the sheet.

4. The conveying apparatus according to claim 1, wherein the intermediate bearing has a surface which contacts the conveying roller.

5. The conveying apparatus according to claim 4, wherein the surface of the intermediate bearing has a circular shape.

6. The conveying apparatus according to claim 4, wherein the surface of the intermediate bearing is arranged at a position which does not overlap a course of a maximum width sheet, wherein the maximum width sheet has a width that, if any larger, would prevent the maximum width sheet from being conveyed through the conveying apparatus.

7. The conveying apparatus according to claim 1, wherein the intermediate bearing has two surfaces which contact the conveying roller.

8. The conveying apparatus according to claim 1, wherein the conveying roller is a roller which is arranged on an upstream side of a recording head in a conveying direction of the sheet, wherein the recording head is an ink jet recording head which records by discharging ink.

9. The conveying apparatus according to claim 1, wherein a portion of the conveying roller contacted by the intermediate bearing does not contact a maximum width sheet, when the maximum width sheet is conveyed by the conveying roller, wherein the maximum width sheet has a width that, if any larger, would prevent the maximum width sheet from being conveyed through the conveying apparatus.

10. A recording apparatus comprising:

a recording head configured to record an image on a sheet;

a conveying roller configured to convey the sheet;

a pair of bearings supporting the conveying roller, wherein each bearing has a first surface and a second surface which contact and support axis portions of the conveying roller;

a pressing roller which presses the conveying roller towards the first surface and the second surface, of each of the pair of bearings, wherein a first plane extended from the first surface and a second plane extended from the second surface are nonparallel and cross; and an intermediate bearing which is arranged between the pair of bearings and presses the conveying roller toward where the first plane and the second plane cross.

* * * * *